US006145174A

United States Patent [19]

Podlesny et al.

[11] Patent Number: 6,145,174

[45] Date of Patent: Nov. 14, 2000

[54] STRETCHER ROLLER

[76] Inventors: Michael Podlesny, Liesel-Waller-Strasse 19, 40882 Ratingen; Karl-Heinz Schneiders, Zum Stadion 30, 40764 Langenfeld, both of Germany

[21] Appl. No.: 09/536,585

[22] Filed: Mar. 28, 2000

[51] Int. Cl.[7] ..... D06C 3/06

[52] U.S. Cl. ..... 26/99; 26/105; 492/35

[58] Field of Search ..... 26/99, 101, 104, 26/105, 103, 97, 100; 264/288.4, 290.2, 291; 492/27, 28, 30, 31, 35, 37, 44, 43, 48

[56] References Cited

U.S. PATENT DOCUMENTS

| | | | |
|---|---|---|---|
| 1,435,712 | 11/1922 | Livesey | 26/105 |
| 1,563,704 | 1/1925 | Greis | 26/105 |
| 1,716,555 | 6/1929 | Kane | 26/99 |
| 3,332,131 | 7/1967 | Weiler | 492/35 |
| 3,374,648 | 3/1968 | Maguire | 492/35 |
| 3,528,145 | 9/1970 | Troope et al. | 26/105 |
| 3,545,054 | 12/1970 | Sando et al. | 26/105 |
| 4,566,162 | 1/1986 | Brands | 26/105 |
| 4,872,246 | 10/1989 | Yano | 492/35 |
| 5,188,273 | 2/1993 | Schmoock | 26/105 |
| 5,455,992 | 10/1995 | Kurschatke et al. | 26/99 |

*Primary Examiner*—Amy B. Vanatta

*Attorney, Agent, or Firm*—Renner, Otto, Boisselle & Sklar, LLP

[57] ABSTRACT

A stretcher roller for spreading out moving flexible strip material such as for example plastics film, paper or textiles, has a cylindrical outer surface of elastomeric material, with inclined incisions which are separated from one another by webs. The transition from the surface into an incision which makes an included angle of less than 90° is of rounded or chamfered form. In this way a sharp-edged transition from the surface into the incision in question is avoided. Such sharp edges can damage the strip material if it enters the incision, which is particularly likely at the ends of the roller. The rounded transition avoids this damage.

11 Claims, 3 Drawing Sheets

STRETCHER ROLLER

The invention relates to a stretcher roller for spreading out moving flexible strip material such as for example plastics film, paper or textiles.

Such a stretcher roller is known from DE A 295 22 011. This comprises a rigid roller body having bearing spindles at its ends. A covering of elastomeric material is mounted on the roller body. The elastomeric covering contains incisions extending in from its surface and inclined to the longitudinal axis of the roller body, the incisions being inclined from inwards to outwards on each side of the radial central plane of the roller, respectively towards the adjacent outer end of the roller. The incisions provided on each side of the radial central plane of the roller are in the form of respective matching helices or spirals. Each helix is undercut. Each helix extends from the central plane towards the respective outer end of the roller. The inner ends of the helical incisions are angularly offset with respect to one another so that the inner ends of the helices do not lie side by side. The inner ends of the helical incisions are in fact offset with respect to one another through 180°.

The incisions are bounded by arcuate flanks, while the bottoms of the incisions are rounded. The transition from the roller surface into an incision extends in rounded or chamfered form on the one side. On the other side it is sharp edged. These sharp edges make an included angle of less than 90°. The rounded transition of an incision is spatially further away from the radial central plane than the sharp-edged transition of the same incision.

The roller body may have non-cylindrical portions in order to avoid a deficient spreading action in the central region. For the same reason a perpendicular incision can be provided in the central part of the covering of the stretcher roller.

The rounded transitions avoid any squeezing or deflection of the strip material by sharp edges. The helical shape of the incisions, and their inclination result in a uniform and good stretching of the strip material during operation.

Nonetheless, deflections or distortions can arise with this stretcher roller, in particular in the edge region of a thin film.

It is an aim of the invention to provide a stretcher roller which avoids the above-mentioned deflections or distortions in thin strip material during operation.

According to the present invention, a stretcher roller comprises a roller body mounted for rotation about a longitudinal axis, with an outer surface of elastomeric material, said elastomeric outer surface being substantially cylindrical, and having at least one incision inclined to said longitudinal axis, and a transition surface from said outer surface into said incision making an included angle of less than 90°, and being rounded.

This avoids a sharp-edged transition from the outer surface to the incision thus reducing deflections and distortions of the strip material.

The incisions which are affected in particular are those at each end of the roller. At these ends edge regions of a film can enter into the incisions. The relevant edge regions of the film could then be damaged by sharp edges. The problem is avoided by the rounding or chamfering.

Preferably the outer surface has no sharp edges, but solely rounded transitions between the surface and the incisions. Folds or deflections in the strip material which is stretched, are avoided in the best way by rounded portions.

Preferably a central region of the outer surface is recessed in particular by 0.1 to 0.5 millimeters. This recessed region is for its part cylindrical and has a longitudinal extent of preferably 10 to 100 millimeters.

It has been shown that on the loading of the roller body the regions of the surface of the roller which lie distant from the central plane are relatively lightly pressed in by the load. Strip material is then exposed during operation to a greater pressure in the middle region than in the edge region. The difference in pressure affects the uniformity of the stretching action. Such non-uniform loading is avoided, or at least reduced, by the recessing. The stretching action is thus improved. Also such a recessed region can be easily and therefore economically produced.

Embodiments of the invention are illustrated by way of example in the accompanying drawings, in which.

Figure 1:
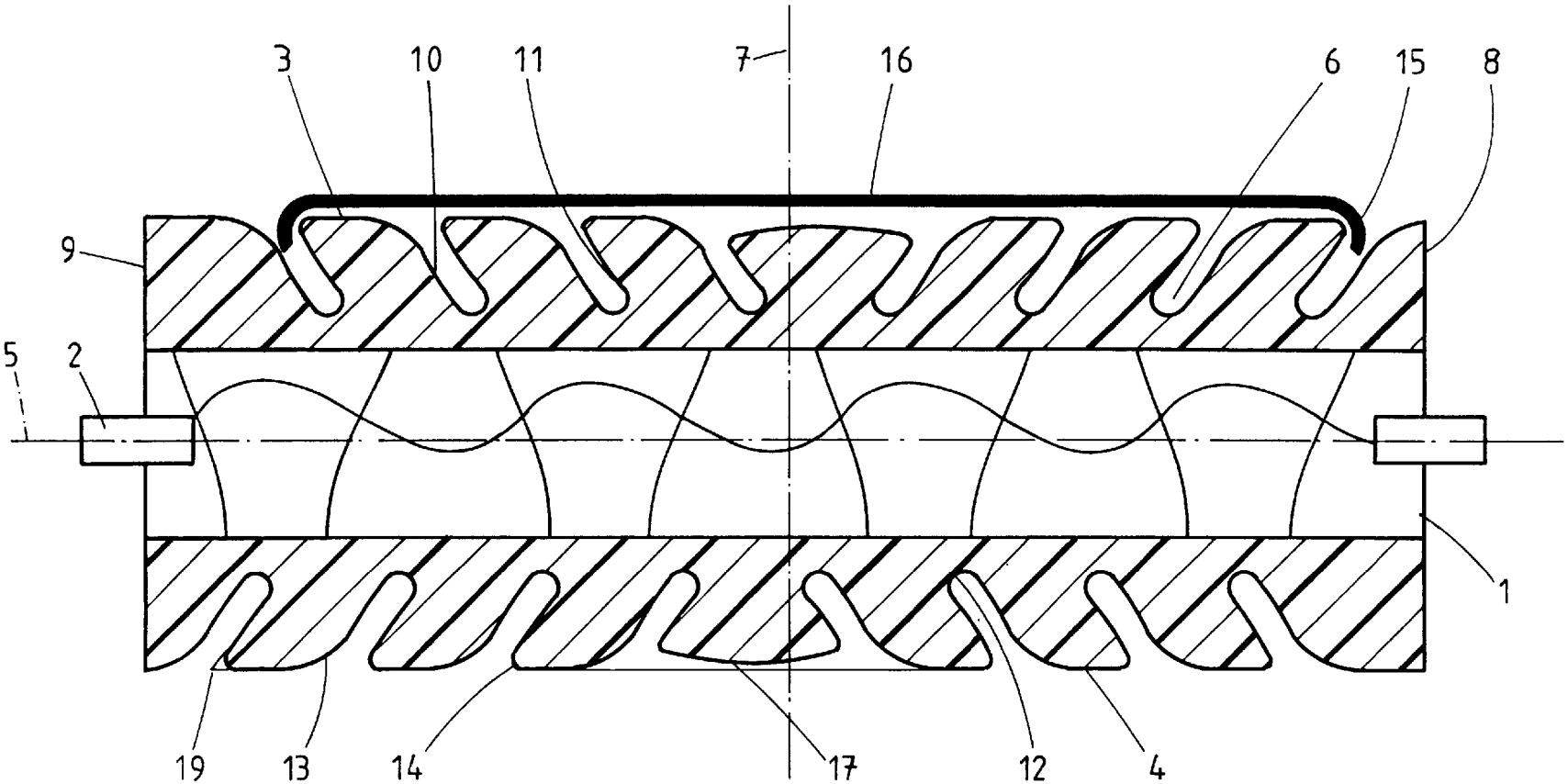
FIG. 1 shows in section a stretcher roller for spreading out moving flexible strip material such as for example plastics film, paper or textiles.

The stretcher roller of FIG. 1 comprises a rigid roller body 1 having bearing pins or trunnions 2 at its ends by which it is mounted for rotation about a longitudinal axis 5. A sleeve-shaped covering 3 of elastomeric material is mounted on the body 1. The elastomeric covering 3 has a substantially cylindrical outer surface 4, which contains incisions 6 which extend in from its surface 4. Two incisions 6 are provided, one on each side of a radial central plane 7 of the roller 1. Each incision runs in a direction inclined to the longitudinal axis 5 of the roller body, and is inclined from inwards to outwards towards an adjacent end 8 or 9 of the roller 1. Each incision 6 is made in the form of a uniform helix or spiral. Each helix is therefore undercut. Both helices extend from the central plane 7 towards the respective outer ends 8 and 9 of the roller. The inner ends of the helical incisions 6 are arranged offset relative to one another through 180°, so that the inner ends of the helices do not lie next to one another.

The incisions are defined by flanks 10 and 11 which are preferably of arcuate shape, and a rounded bottom 12. Each transition 13 and 14 from the cylindrical outer surface 4 into the incision 6 extends in a rounded or chamfered way. The one transition 13 of an incision is spatially further away from the radial central plane than the other transition 14 of the same incision 6. The transition 14 makes an inclined angle of less than 90° between the surface 4 and the flank 11.

Deflections or folds caused by sharp edges are avoided by the rounded transitions. In addition the spiral-shaped homogeneous extent of the inclinations of the incisions results in a uniform and good stretching of the strip material during operation.

Near the ends 8 and 9 edge regions 15 of a thin strip material 16 can enter the incisions 6. The strip material could then be damaged to a particular extent in its relevant edge regions 15 by sharp edges. The problem is avoided by the rounded portions 14.

The outer surface is substantially cylindrical, but in the region of the central plane 7 the cylindrical surface is slightly recessed in relation to the surface 4, and in fact by 0.3 millimeters. This recessed region 17 is for its part substantially cylindrical and has a longitudinal extent of 25 millimeters. In order to illustrate the recessing a dotted line is indicated, showing the position of the surface 4. It has been found that on loading of the roller body the regions of the surface of the roller which lie remote from the central plane are comparatively lightly pressed in by the load. Strip material is then subjected to a greater pressure in the central region during operation than in the edge region. The difference in pressure affects the uniformity of the stretching action. The recessing ensures that such non-uniform loading is avoided or at least reduced. The stretching action is thus improved. Also the recessed region can be produced easily and thereby economically.

The transition between the cylindrical surface 4 of the stretcher roller and the recessed region 17 extends arcuately. Thus here again edges are avoided which could leave behind them folds or ridges in the strip material.

Figure 2:
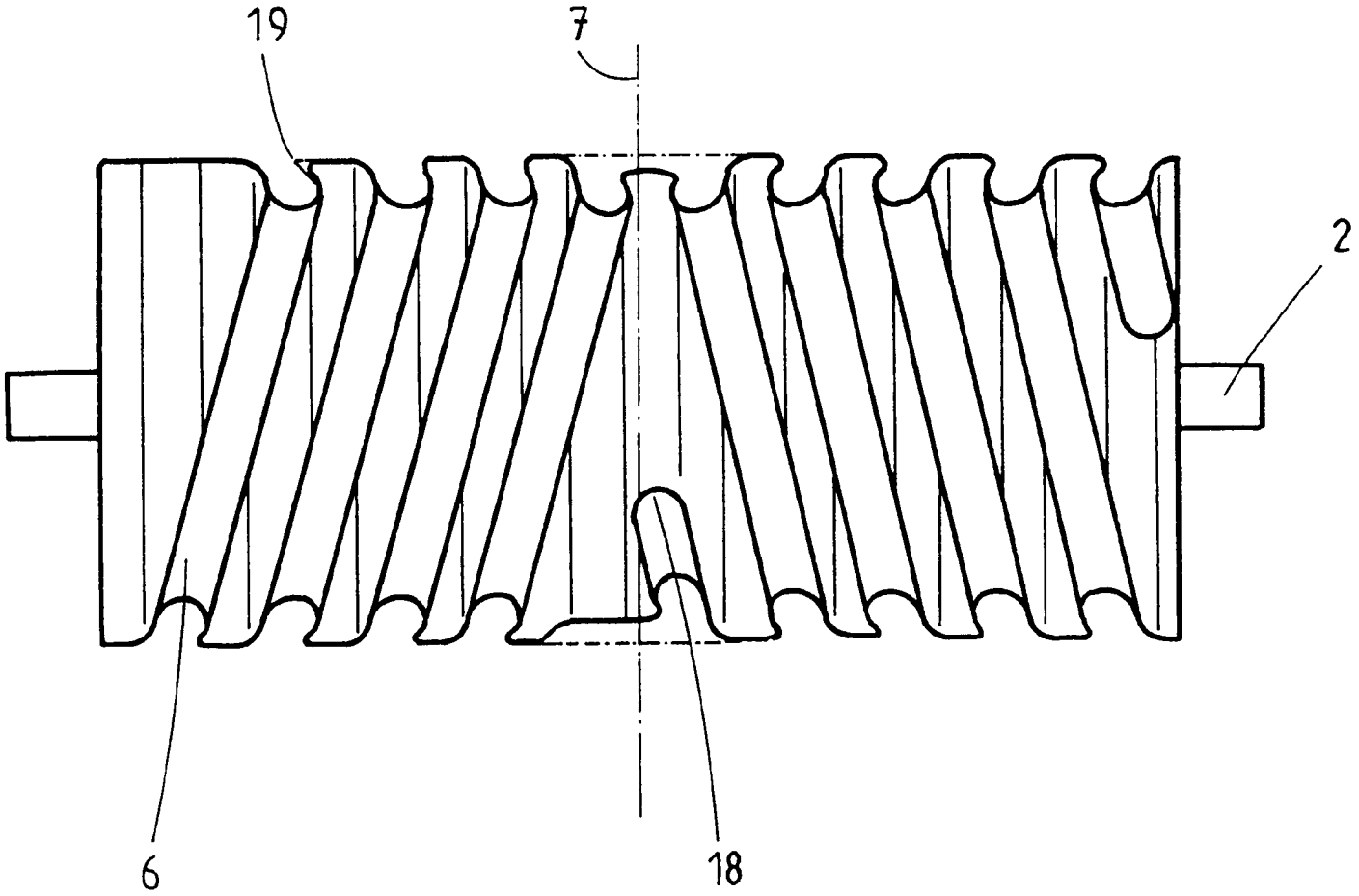
FIG. 2 is a side view of the roller of FIG. 1.

FIG. 2 is an external view of the stretcher roller. The inner end 18 of one helical incision 6 opens into that side which is illustrated in this view. The other inner end of the second helix is offset through 180° to lie on the opposite side and is therefore not visible.

The reference numeral 19 in the drawings shows the state of the art referred to in the introduction with the transition at an angle of less than 90° and a sharp edge is provided instead of a blunt one formed by the chamfering or rounding or arcuate form.

Figure 3:
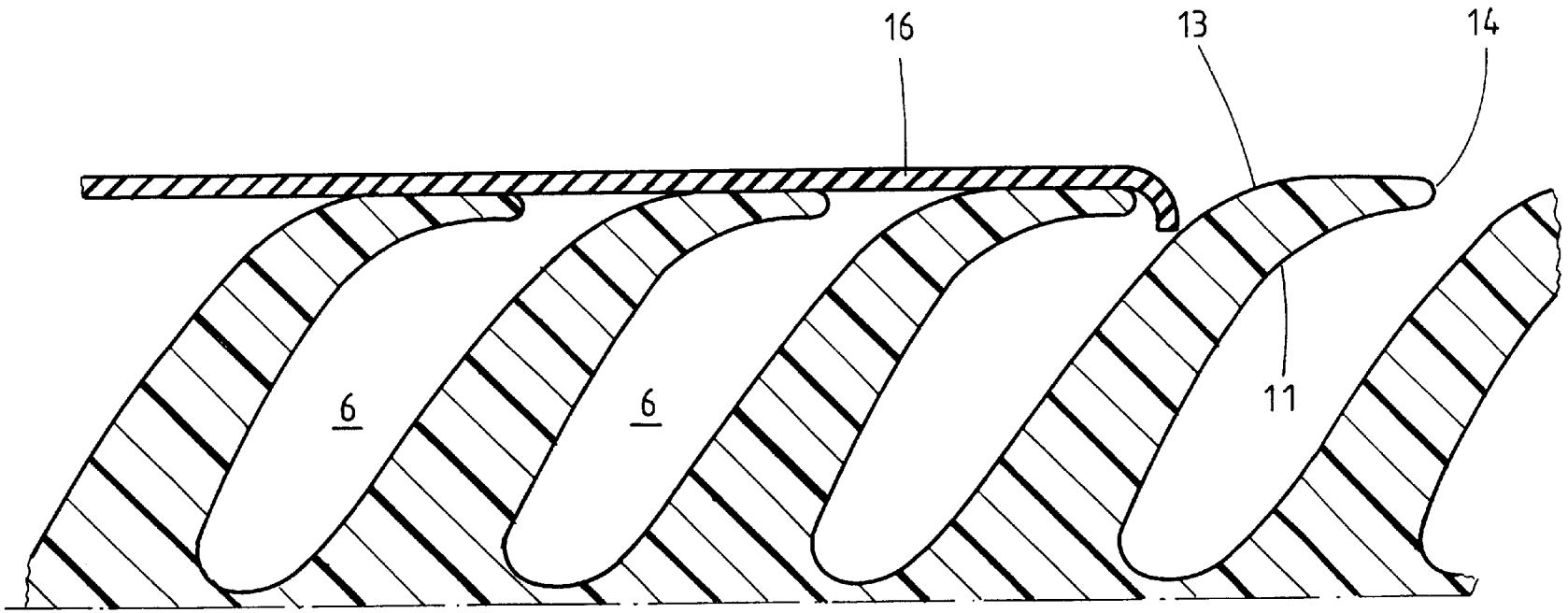
FIG. 3 shows an enlarged section through a further embodiment of the roller.

FIG. 3 shows an enlarged section through a further embodiment of incisions 6 in the surface of a stretcher roller, and corresponding reference numerals have been applied to corresponding parts. In FIG. 3 the pitch of the helical incision 6 is reduced and the included angle at the transition 14 is also smaller.

What is claimed is:

1. A stretcher roller comprising a roller body mounted for rotation about a longitudinal axis, with an outer surface of elastomeric material, said elastomeric outer surface being substantially cylindrical, and having at least one incision inclined to said longitudinal axis, and a transition surface from said outer surface into said incision making an included angle of less than 90°, and being rounded.

2. A stretcher roller according to claim 1, wherein said outer surface has solely rounded transitions between the outer surface and the incisions.

3. A stretcher roller according to claim 1 wherein a central region of the outer surface is recessed.

4. A stretcher roller according to claim 3, wherein said central region is recessed by 0.1 to 0.5 millimeters.

5. A stretcher roller according to claim 3, wherein said recessed region has a cylindrical surface.

6. A stretcher roller according to claim 5, wherein said recessed region extends longitudinally between 10 and 100 millimeters.

7. A stretcher roller according to claim 3 wherein said transition between said cylindrical outer surface and said recessed region is arcuate.

8. A stretcher roller according to claim 1, wherein two incisions are provided, one on each side of the radial central plane of said roller, each said incision being inclined from inside to outside respectively towards the associated end of said roller.

9. A stretcher roller according to claim 8, wherein each said incision is in the form of an undercut uniform helix extending from said central plane towards the respective outer end of said roller.

10. A stretcher roller according to claim 9, wherein inner ends of the helical incisions which lie at said central plane are offset relative to one another so that the inner ends of said helices do not lie side by side.

11. A stretcher roller according to claim 1, wherein said outer surface comprises a sleeve of elastomeric material mounted on a separate rigid roller body.

* * * * *